US006250075B1

(12) United States Patent
Funakoshi et al.

(10) Patent No.: US 6,250,075 B1
(45) Date of Patent: Jun. 26, 2001

(54) ENGINE MUFFLER

(75) Inventors: Hirokazu Funakoshi, Hamura; Hidenori Mukaida, Ohme, both of (JP)

(73) Assignee: Shin-Daiwa Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/293,975

(22) Filed: Apr. 19, 1999

(30) Foreign Application Priority Data

Jun. 30, 1998 (JP) ..... 10-185079

(51) Int. Cl.[7] ..... F01N 3/10
(52) U.S. Cl. ..... 60/299; 60/302; 60/308
(58) Field of Search ..... 60/274, 276, 277, 60/285, 286, 299, 302, 303, 308

(56) References Cited

U.S. PATENT DOCUMENTS 3,811,845 * 5/1974 Nakamura ..... 60/299
4,890,690 * 1/1990 Fischer et al. ..... 60/299
5,048,290 * 9/1991 Lavenius et al. ..... 60/299
5,373,119 * 12/1994 Suzuki et al. ..... 60/299
5,457,290 * 10/1995 Sase et al. ..... 60/299
5,498,842 * 3/1996 Karlsson ..... 60/302
5,521,339 * 5/1996 Despain et al. ..... 60/299
5,548,955 * 8/1996 Sandefur et al. ..... 60/299
5,590,522 * 1/1997 Kynsilehto et al. ..... 60/299
5,651,249 * 7/1997 Nagao et al. ..... 60/302
5,722,237 * 3/1998 Iida et al. ..... 60/302
5,732,555 * 3/1998 Gracyalny et al. ..... 60/299
5,736,690 * 4/1998 Karlsson ..... 60/302
5,738,184 * 4/1998 Masuda et al. ..... 60/299
5,808,245 * 9/1998 Wiese et al. ..... 60/299
5,902,971 * 5/1999 Sato et al. ..... 60/299
5,916,128 * 6/1999 Garr et al. ..... 60/274

* cited by examiner

*Primary Examiner*—Teresa Walberg
*Assistant Examiner*—Fadi H. Dahbour
(74) *Attorney, Agent, or Firm*—Liniak, Berenato, Longacre & White, LLC

(57) ABSTRACT

An engine muffler is provided which comprises a first expansion chamber for exhaust gas which includes an exhaust gas inlet to be connected to an exhaust port of an engine, a second expansion chamber which includes an exhaust gas outlet, a first exhaust gas purifier in which a catalyst for purifying exhaust gas is coated on at least a concave surface of a concave base body which has a plurality of vent holes passing through the concave surface, the first exhaust gas purifier being disposed in the first expansion chamber such that the concave surface faces the exhaust gas inlet, and at least one second exhaust gas purifier in which a catalyst for purifying exhaust gas is coated on a base body including many pores, the second exhaust gas purifier being disposed between the first expansion chamber and the second expansion chamber. The engine muffler is obtained simply by improving a muffler used for a small-sized engine. The engine muffler has an extremely great effect of purifying exhaust gas.

7 Claims, 8 Drawing Sheets

ENGINE MUFFLER

BACKGROUND OF THE INVENTION

1. Field of the Invention

This invention relates to improvements in an engine muffler for a small-sized engine, for example, of a brush cutter or a chain saw.

2. Description of the Related Art

As shown in FIG. 7, a conventional muffler used for a small-sized engine comprises a first expansion chamber 2 for exhaust gas which includes an exhaust gas inlet 1 to be connected to an exhaust port of the engine, a second expansion chamber 4 which includes an exhaust gas outlet 3, and an exhaust gas purifier 5 disposed between the first expansion chamber 2 and the second expansion chamber 4 in which a catalyst for purifying exhaust gas is coated on a stainless-steel base body including many pores, for example, a honeycomb stainless-steel base body.

In such an engine muffler containing an exhaust gas purifier, as already known, the distance between an exhaust gas inlet and the exhaust gas purifier of a first expansion chamber is designed to be shorter, so that an unburnt gas is completely combusted in the first expansion chamber heated by exhaust gas, and thus substances such as carbon monoxide and nitrogen oxides contained in exhaust gas are decreased.

However, in an engine muffler used for a small-sized engine, the distance between an exhaust gas inlet and an exhaust gas purifier is extremely difficult to make longer.

With regard to the conventional muffler shown in FIG. 7, in order to make as long as possible the distance between the exhaust gas inlet 1 and the exhaust gas purifier 5, and the distance between the exhaust gas purifier 5 and the exhaust gas outlet 3 and also make it compact, the muffler is constructed such that the exhaust gas which has entered at the exhaust gas inlet 1 disposed in the upper part of the first expansion chamber 2, passes through the exhaust gas purifier 5 disposed in the lower part of the adjoining first expansion chamber 2 and second expansion chamber 4, and then is discharged from the exhaust gas outlet 3 disposed in the upper part of the second expansion chamber 4. In the muffler according to this construction, the distance between the exhaust gas inlet 1 of the first expansion chamber 2 and the exhaust gas purifier 5 and the distance between the exhaust gas purifier 5 and the exhaust gas outlet 3 of the second expansion chamber 4 are designed to be as long as possible. However, the intended effect of purifying exhaust gas could not be sufficiently produced.

For the purpose of solving this problem, as shown in FIG. 8, a muffler has been developed which comprises a first expansion chamber 2 for exhaust gas which includes an exhaust gas inlet 1 to be connected to an exhaust port of an engine, a second expansion chamber 4 which includes an exhaust gas outlet 3, a concave exhaust gas receiving member 6 which has a plurality of vent holes **6*b* passing through a concave surface 6*a* thereof, the exhaust gas receiving member 6 being disposed in the first expansion chamber 2 such that the concave surface 6*a* faces the exhaust gas inlet 1, and an exhaust gas purifier 5 in which a catalyst for purifying exhaust gas is coated on a stainless-steel base body including many pores, for example, a honeycomb stainless-steel base body, the exhaust gas purifier 5 being disposed between the first expansion chamber 2 and the second expansion chamber 4**.

In the conventional improved muffler shown in FIG. 8, the concave exhaust gas receiving member 6 which has the plurality of vent holes **6*b* passing through the concave surface 6*a* is disposed in the first expansion chamber 2 such that the concave surface 6*a* faces the exhaust gas inlet 1, so that the concave exhaust gas receiving member 6 produces the effect of noise reduction. In addition, the complete combustion of unburnt gas is conducted by the heat of the concave exhaust gas receiving member 6** which has been heated by exhaust gas, so that the emission of harmful gases such as carbon monoxide and nitrogen oxides contained in exhaust gas can be decreased. However, even in the muffler according to this construction, the intended effect of purifying exhaust gas of harmful substances could not be sufficiently produced.

SUMMARY OF THE INVENTION

In consideration of the aforementioned problems, it is an object of the present invention to provide an engine muffler having a greater effect of purifying exhaust gas of harmful substances, which is capable of decreasing more the emission quantity of harmful substances such as carbon monoxide and nitrogen oxides contained in exhaust gas by improving the conventional muffler shown in FIG. 8.

The engine muffler according to a first aspect of the present invention comprises a first expansion chamber 12 for exhaust gas which includes an exhaust gas inlet 11 to be connected to an exhaust port of an engine; a second expansion chamber 14 which includes an exhaust gas outlet 13; a first exhaust gas purifier 16 in which a catalyst **16*c* for purifying exhaust gas is coated on at least a concave surface 16*a* of a concave base body which has a plurality of vent holes 16*b* passing through the concave surface 16*a*, the first exhaust gas purifier 16 being disposed in the first expansion chamber 12 such that the concave surface 16*a* faces the exhaust gas inlet 11; and at least one second exhaust gas purifier 15 in which a catalyst for purifying exhaust gas is coated on a base body including many pores, the second exhaust gas purifier 15 being disposed between the first expansion chamber 12 and the second expansion chamber 14**.

The engine muffler according to a second aspect of the present invention comprises a first expansion chamber 12 for exhaust gas which includes an exhaust gas inlet 11 to be connected to an exhaust port of an engine; a third expansion chamber 19 which includes an exhaust gas outlet 13; a second expansion chamber 14 which is disposed between the first expansion chamber 12 including the exhaust gas inlet 11 and the third expansion chamber 19 including the exhaust gas outlet 13; a first exhaust gas purifier 16 in which a catalyst **16*c* for purifying exhaust gas is coated on at least a concave surface 16*a* of a concave base body which has a plurality of vent holes 16*b* passing through the concave surface 16*a*, the first exhaust gas purifier 16 being disposed in the first expansion chamber 12 such that the concave surface 16*a* faces the exhaust gas inlet 11; at least one second exhaust gas purifier 15 in which a catalyst for purifying exhaust gas is coated on a base body including many pores, the second exhaust gas purifier 15 being disposed between the first expansion chamber 12 and the second expansion chamber 14; and a third exhaust gas purifier 20 in which a catalyst for purifying exhaust gas is coated on a base body including many pores, the third exhaust gas purifier 20 being disposed between the second expansion chamber 14 and the third expansion chamber 19**.

The engine muffler according to a third aspect of the present invention comprises a first expansion chamber 12 for exhaust gas which includes an exhaust gas inlet 11 to be connected to an exhaust port of an engine; a second expansion chamber 14 which includes an exhaust gas outlet 13; a first exhaust gas purifier 16 in which a catalyst for purifying exhaust gas is coated on at least a concave surface 16*a* of a concave base body which has a plurality of vent holes 16*b* passing through the concave surface 16*a*, the first exhaust gas purifier 16 being disposed in the first expansion chamber 12 such that the concave surface 16*a* faces the exhaust gas inlet 11; at least one second exhaust gas purifier 15 in which a catalyst for purifying exhaust gas is coated on a base body including many pores, the second exhaust gas purifier 15 being disposed between the first expansion chamber 12 and the second expansion chamber 14; and a wire net 21 coated with a catalyst for purifying exhaust gas, the wire net 21 being disposed near the exhaust gas outlet 13.

The engine muffler according to a fourth aspect of the present invention comprises a first expansion chamber 12 for exhaust gas which includes an exhaust gas inlet 11 to be connected to an exhaust port of an engine; a third expansion chamber 19 which includes an exhaust gas outlet 13; and a second expansion chamber 14 which is disposed between the first expansion chamber 12 including the exhaust gas inlet 11 and the third expansion chamber 19 including the exhaust gas outlet 13; a first exhaust gas purifier 16 in which a catalyst for purifying exhaust gas is coated on at least a concave surface 16*a* of a concave base body which has a plurality of vent holes 16*b* passing through the concave surface 16*a*, the first exhaust gas purifier 16 being disposed in the first expansion chamber 12 such that the concave surface 16*a* faces the exhaust gas inlet 11; at least one second exhaust gas purifier 15 in which a catalyst for purifying exhaust gas is coated on a base body including many pores, the second exhaust gas purifier 15 being disposed between the first expansion chamber 12 and the second expansion chamber 14; a third exhaust gas purifier 20 in which a catalyst for purifying exhaust gas is coated on a base body including many pores, the third exhaust gas purifier 20 being disposed between the second expansion chamber 14 and the third expansion chamber 19; and a wire net 21 coated with a catalyst for purifying exhaust gas, the wire net 21 being disposed near the exhaust gas outlet 13.

Further, in the engine muffler according to a fifth aspect of the present invention, the first expansion chamber 12 and the second expansion chamber 14 are, at least, defined by dividing a muffler body 18 with a partition plate 17, and the adhesion of the partition plate 17 to an inner wall 18*a* of the muffler body 18 and the adhesion of the second exhaust gas purifier 15 to the partition plate 17 are conducted by soldering in a continuous hydrogen furnace 22 in the absence of oxygen.

DETAILED DESCRIPTION OF THE PREFERRED EMBODIMENTS

The engine muffler according to a first aspect of the present invention will be described in detail with reference to the attached drawings.

Figure 1:
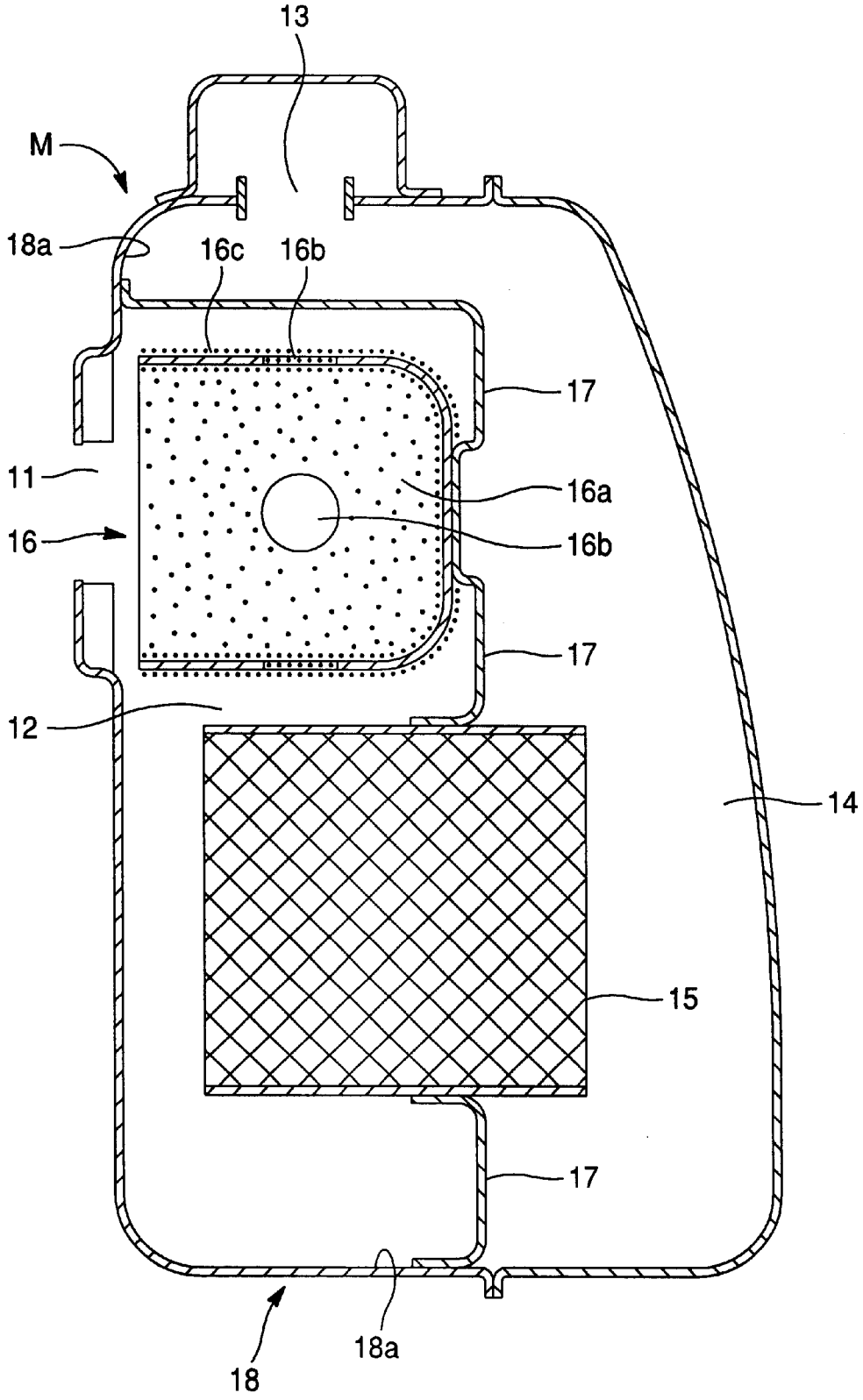
FIG. 1 is a vertical sectional view of the engine muffler according to a first aspect of the present invention.

As shown in FIG. 1, the engine muffler according to the first aspect of the present invention comprises a first expansion chamber 12 for exhaust gas which includes an exhaust gas inlet 11 to be connected to an exhaust port of an engine (not shown) in the upper part thereof, and a second expansion chamber 14 which includes an exhaust gas outlet 13 in the upper part thereof. The first expansion chamber 12 and the second expansion chamber 14 are defined left and right in FIG.1 by dividing the inside of a muffler body 18 with a partition plate 17.

Further, the engine muffler comprises a first exhaust gas purifier 16 in which a catalyst 16*c*, such as platinum or rhodium, for purifying exhaust gas is coated on at least a concave surface 16*a* of a concave stainless-steel base body which has a plurality of vent holes 16*b* passing through the concave surface 16*a*, the first exhaust gas purifier 16 being disposed in the first expansion chamber 12 such that the concave surface 16*a* faces the exhaust gas inlet 11. Herein, the catalyst 16*c* may also coat the whole surface of the concave stainless-steel base body.

Further, the engine muffler comprises a second exhaust gas purifier 15 in which a catalyst, such as platinum or rhodium, for purifying exhaust gas is coated on a stainless-steel base body including many pores, for example, a honeycomb stainless-steel base body, the second exhaust gas purifier 15 being disposed between the lower part of the first expansion chamber 12 and the lower part of the second expansion chamber 14.

Figure 2:
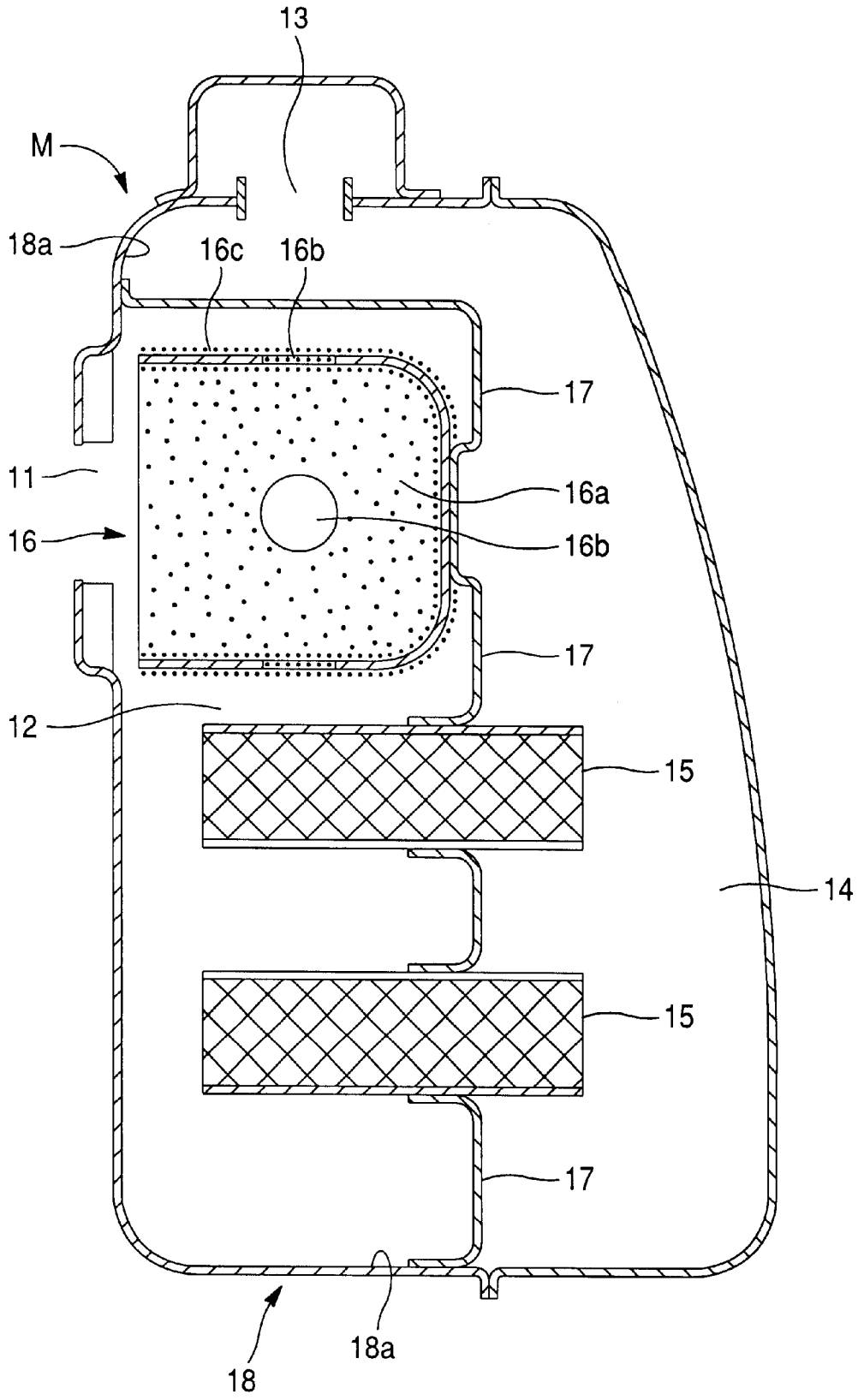
FIG. 2 is a vertical sectional view of the engine muffler according to a variation of the first aspect of the present invention.

As shown in FIG. 2, a plurality of small-sized exhaust gas purifiers 15, 15 may also be used as the second exhaust gas purifier 15. If there is a product which has already been available in the market as a muffler component used for a small-sized engine, a plurality of those products may also be used as the small-sized exhaust gas purifier 15, which can contribute to lowering the cost of production.

Herein, the adhesion of the partition plate 17 which has divided the inside of the muffler body 18 into the first expansion chamber 12 and the second expansion chamber 14 to an inner wall 18*a* of the muffler body 18 is conducted by a method mentioned later. The adhesion of the first exhaust gas purifier 16 and the second exhaust gas purifier 15 to the partition plate 17 is conducted by a method mentioned later.

The engine muffler according to the first aspect of the present invention is constructed in this way, so that an unburnt gas is completely combusted by the heat of the first exhaust gas purifier 16 which has been heated to a high temperature by exhaust gas, substances such as carbon monoxide and nitrogen oxides contained in exhaust gas are removed by a catalyst 16*c* for purifying exhaust gas coated on a concave base body having vent holes 16*b* in its circumferential part in the first exhaust gas purifier 16, and substances such as carbon monoxide and nitrogen oxides contained in exhaust gas are removed by a catalyst for purifying exhaust gas coated on a base body in the second exhaust gas purifier 15. These functions can further heighten the effect of purifying exhaust gas.

Further, the first exhaust gas purifier is formed only by applying a coat of a catalyst for purifying exhaust gas onto a conventional concave exhaust gas receiving member, so that the first exhaust gas purifier can be used without heightening the cost of production and without lessening the effect of noise reduction.

Figure 3:
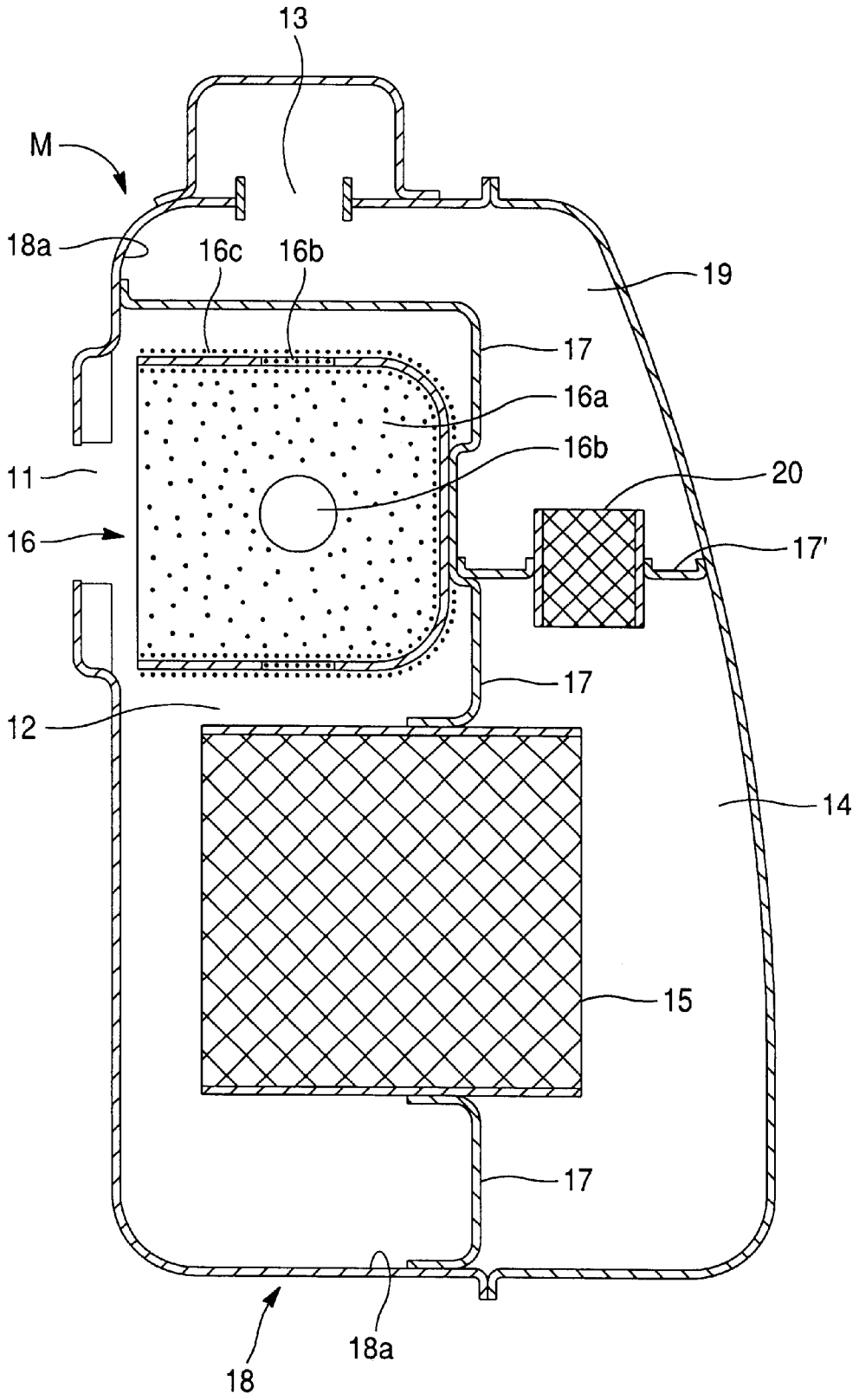
FIG. 3 is a vertical sectional view of the engine muffler according to a second aspect of the present invention.

As shown in FIG. 3, the engine muffler according to the second aspect of the present invention comprises a first expansion chamber 12 for exhaust gas which includes an exhaust gas inlet 11 to be connected to an exhaust port of an engine, a third expansion chamber 19 which includes an exhaust gas outlet 13, and a second expansion chamber 14 which is disposed between the first expansion chamber 12 including the exhaust gas inlet 11 and the third expansion chamber 19 including the exhaust gas outlet 13. Herein, the first expansion chamber 12, the third expansion chamber 19 and the second expansion chamber 14 are defined by dividing the inside of the muffler body 18 with a partition plate 17 and a partition plate 17'. In FIG. 3, the second expansion chamber 14 and the third expansion chamber 19 are situated lengthwise with adjoining each other at the right of the inside of the muffler body 18, and the first expansion chamber 12 is situated at the left of the second expansion chamber 14 and the third expansion chamber 19.

Further, the engine muffler comprises a first exhaust gas purifier 16 in which a catalyst 16*c*, such as platinum or rhodium, for purifying exhaust gas is coated on a concave surface 16*a* or the whole surface of a concave stainless-steel base body which has a plurality of vent holes 16*b* passing through the concave surface 16*a*, the first exhaust gas purifier 16 being disposed in the first expansion chamber 12 such that the concave surface 16*a* faces the exhaust gas inlet 11. Further, the engine muffler comprises at least one second exhaust gas purifier 15 in which a catalyst for purifying exhaust gas is coated on a base body including many pores, the second exhaust gas purifier 15 being disposed between the first expansion chamber 12 and the second expansion chamber 14. In the aforementioned points, the engine muffler has the same construction as that according to the first aspect of the present invention.

The engine muffler according to the second aspect of the present invention is different from that according to the first aspect of the present invention in that the former comprises a third exhaust gas purifier 20 in which a catalyst for purifying exhaust gas is coated on a base body including many pores, the third exhaust gas purifier 20 being disposed between the second expansion chamber 14 and the third expansion chamber 19.

The engine muffler according to the second aspect of the present invention is constructed in this way, so that an unburnt gas is completely combusted by the heat of the first exhaust gas purifier 16 which has been heated to a high temperature by exhaust gas, substances such as carbon monoxide and nitrogen oxides contained in exhaust gas are removed by a catalyst 16*c* for purifying exhaust gas coated on a concave base body having vent holes 16*b* in its circumferential part in the first exhaust gas purifier 16, substances such as carbon monoxide and nitrogen oxides contained in exhaust gas are removed by a catalyst for purifying exhaust gas coated on a base body in the second exhaust gas purifier 15, and substances such as carbon monoxide and nitrogen oxides contained in exhaust gas are removed by a catalyst for purifying exhaust gas coated on a base body in the third exhaust gas purifier 20. In short, exhaust gas is purified through the three steps, so that the effect of purifying exhaust gas can be further heightened.

Figure 4:
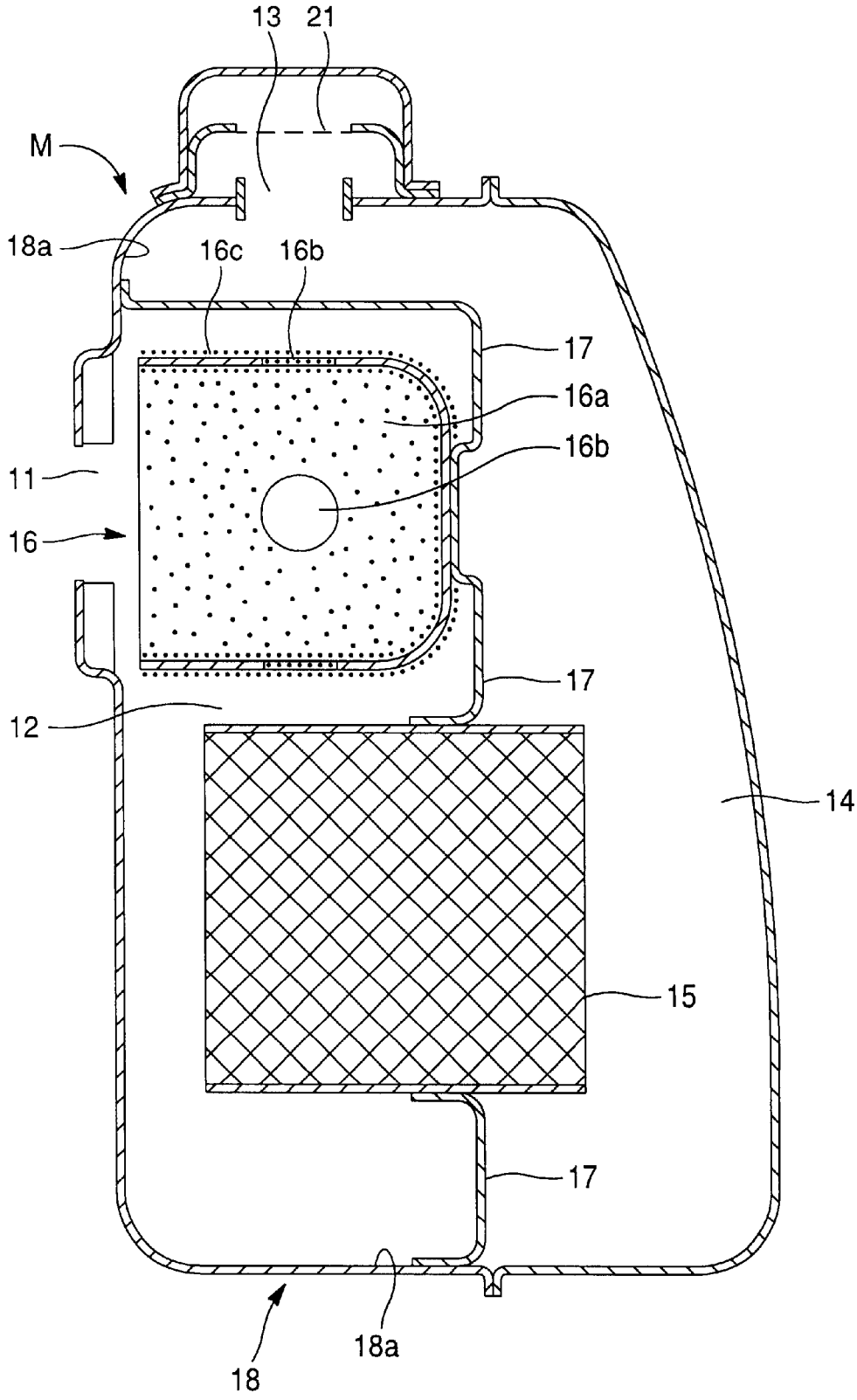
FIG. 4 is a vertical sectional view of the engine muffler according to a third aspect of the present invention.

As shown in FIG. 4, the engine muffler according to the third aspect of the present invention comprises a first expansion chamber 12 for exhaust gas which includes an exhaust gas inlet 11 to be connected to an exhaust port of an engine (not shown) in the upper part thereof, and a second expansion chamber 14 which includes an exhaust gas outlet 13 in the upper part thereof. The first expansion chamber 12 and the second expansion chamber 14 are defined left and right in FIG. 4 by dividing the inside of a muffler body 18 with a partition plate 17.

Further, the engine muffler comprises a first exhaust gas purifier 16 in which a catalyst 16*c*, such as platinum or rhodium, for purifying exhaust gas is coated on a concave surface 16*a* or the whole surface of a concave stainless-steel base body which has a plurality of vent holes 16*b* passing through the concave surface 16*a*, the first exhaust gas purifier 16 being disposed in the first expansion chamber 12 such that the concave surface 16*a* faces the exhaust gas inlet 11.

Further, the engine muffler comprises a second exhaust gas purifier 15 in which a catalyst, such as platinum or rhodium, for purifying exhaust gas is coated on a stainless-steel base body including many pores, for example, a honeycomb stainless-steel base body, the second exhaust gas purifier 15 being disposed between the lower part of the first expansion chamber 12 and the lower part of the second expansion chamber 14. In the aforementioned points, the engine muffler has the same construction as that according to the first aspect of the present invention.

The engine muffler according to the third aspect of the present invention is different from that according to the first aspect of the present invention in that the former comprises a wire net 21 in which a catalyst for purifying exhaust gas is coated on a stainless-steel wire net body, the wire net 21 being disposed near the exhaust gas outlet 13. In the engine muffler which comprises the wire net 21 disposed near the exhaust gas outlet 13, sparks of fire can be prevented from being emitted from the exhaust gas outlet 13, and exhaust gas can be further purified with the wire net 21 coated with a catalyst for purifying exhaust gas.

The engine muffler according to the third aspect of the present invention is constructed in this way, so that the complete combustion of unburnt gas is conducted by the heat of the first exhaust gas purifier which has been heated to a high temperature by exhaust gas, substances such as carbon monoxide and nitrogen oxides contained in exhaust gas are removed by a catalyst for purifying exhaust gas coated on the base body of the first exhaust gas purifier, and substances such as carbon monoxide and nitrogen oxides contained in exhaust gas are removed by a catalyst for purifying exhaust gas coated on the base body of the second exhaust gas purifier. These functions can further heighten the effect of purifying exhaust gas, and sparks of fire can be prevented from being emitted from the exhaust gas outlet with the interceptive function of the wire net which is disposed near the exhaust gas outlet.

Figure 5:
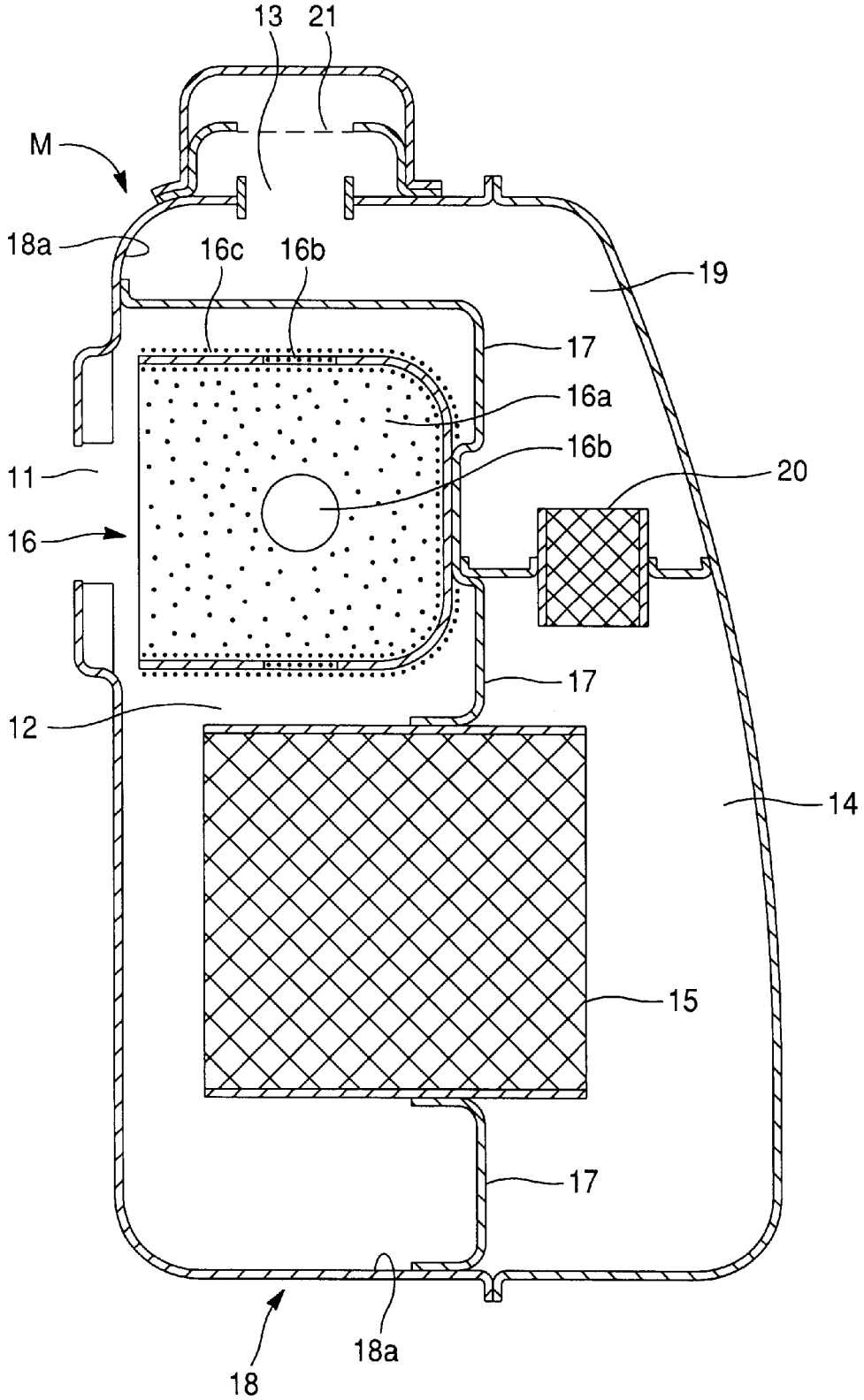
FIG. 5 is a vertical sectional view of the engine muffler according to a fourth aspect of the present invention.

As shown in FIG. 5, the engine muffler according to the fourth aspect of the present invention comprises a first expansion chamber 12 for exhaust gas which includes an exhaust gas inlet 11 to be connected to an exhaust port of an engine, a third expansion chamber 19 which includes an exhaust gas outlet 13, a second expansion chamber 14 which is disposed between the first expansion chamber 12 including the exhaust gas inlet 11 and the third expansion chamber 19 including the exhaust gas outlet 13, a first exhaust gas purifier 16 in which a catalyst for purifying exhaust gas is coated on at least a concave surface 16*a* of a concave base body which has a plurality of vent holes 16*b* passing through the concave surface 16*a*, the first exhaust gas purifier 16 being disposed in the first expansion chamber 12 such that the concave surface 16*a* faces the exhaust gas inlet 11, at least one second exhaust gas purifier 15 in which a catalyst for purifying exhaust gas is coated on a base body including many pores, the second exhaust gas purifier 15 being disposed between the first expansion chamber 12 and the second expansion chamber 14, and a third exhaust gas purifier 20 in which a catalyst for purifying exhaust gas is coated on a base body including many pores, the third exhaust gas purifier 20 being disposed between the second expansion chamber 14 and the third expansion chamber 19. In the aforementioned points, the engine muffler has the same construction as that according to the second aspect of the present invention.

The engine muffler according to the fourth aspect of the present invention is different from that according to the second aspect of the present invention in that the former comprises a wire net 21 coated with a catalyst for purifying exhaust gas, the wire net 21 being disposed near the exhaust gas outlet 13.

In the engine muffler which comprises the first exhaust gas purifier 16, the second exhaust gas purifier 15 and the third exhaust gas purifier 20, exhaust gas is purified through the three steps, so that the effect of purifying exhaust gas can be further heightened. In addition, in the engine muffler which comprises the wire net, sparks of fire can be prevented from being emitted from the exhaust gas outlet 13, and exhaust gas can be further purified with the wire net 21 coated with a catalyst for purifying exhaust gas.

The engine muffler according to the fourth aspect of the present invention is constructed in this way, so that the complete combustion of unburnt gas is conducted by the heat of the first exhaust gas purifier which has been heated to a high temperature by exhaust gas, substances such as carbon monoxide and nitrogen oxides contained in exhaust gas are removed by a catalyst for purifying exhaust gas coated on the base body of the first exhaust gas purifier, and substances such as carbon monoxide and nitrogen oxides contained in exhaust gas are removed by a catalyst for purifying exhaust gas coated on the base body of the second exhaust gas purifier and the base body of the third exhaust gas purifier. In short, exhaust gas is purified through the three steps, so that the effect of purifying exhaust gas can be further heightened. In addition, sparks of fire can be prevented from being emitted from the exhaust gas outlet with the interceptive function of the wire net which is disposed near the exhaust gas outlet.

As shown in FIGS. 1 to 5, in the engine muffler according to the fifth aspect of the present invention, the first expansion chamber 12, the second expansion chamber 14 and the third expansion chamber 19 are defined by dividing the inside of a muffler body 18 with partition plates 17, 17', and the adhesion of the partition plates 17, 17' to an inner wall 18*a* of the muffler body 18 and the adhesion of the second exhaust gas purifier 15 and the third exhaust gas purifier 20 to the partition plates 17, 17' are conducted by soldering in a continuous hydrogen furnace 22 in the absence of oxygen.

Figure 6:
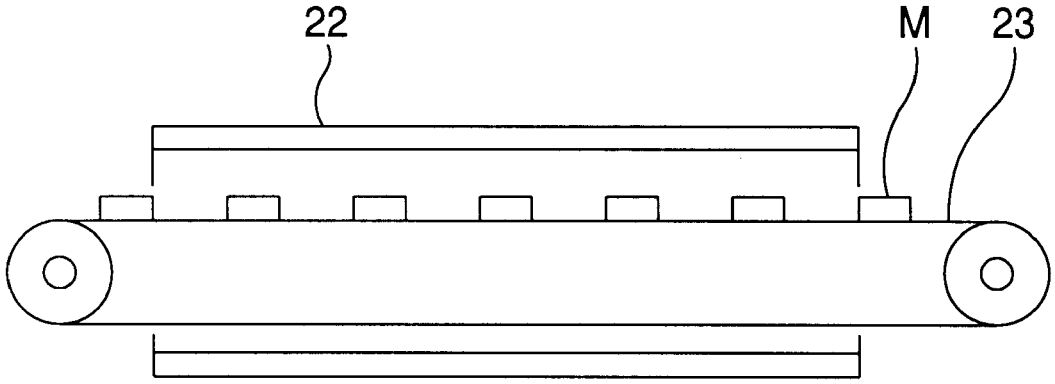
FIG. 6 is a schematic view of a continuous hydrogen furnace in the absence of oxygen according to a fifth aspect of the present invention.
Figure 7:
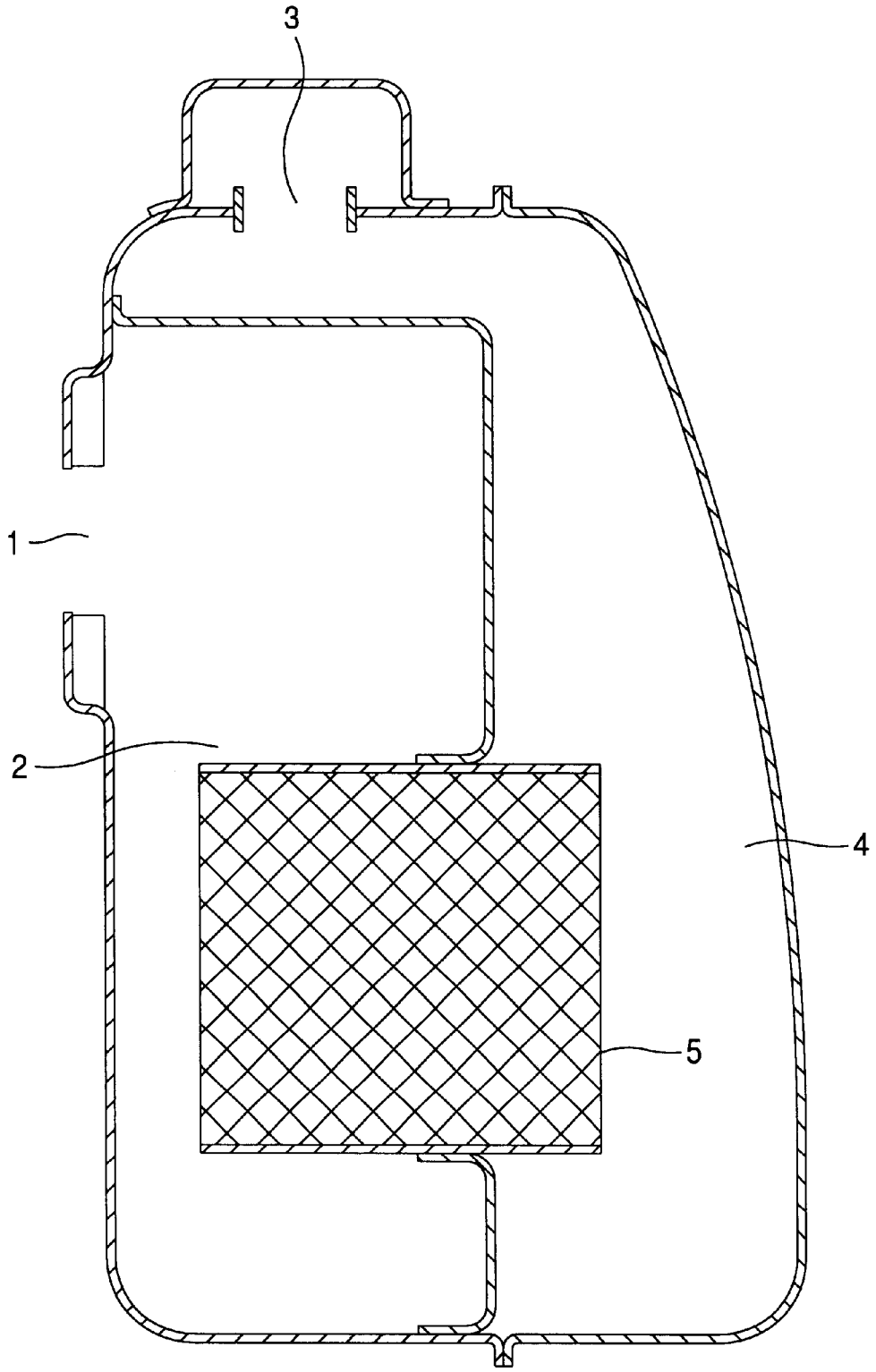
Fig. 7 Prior Art
FIG. 7 is a vertical sectional view of a conventional engine muffler.
Figure 8:
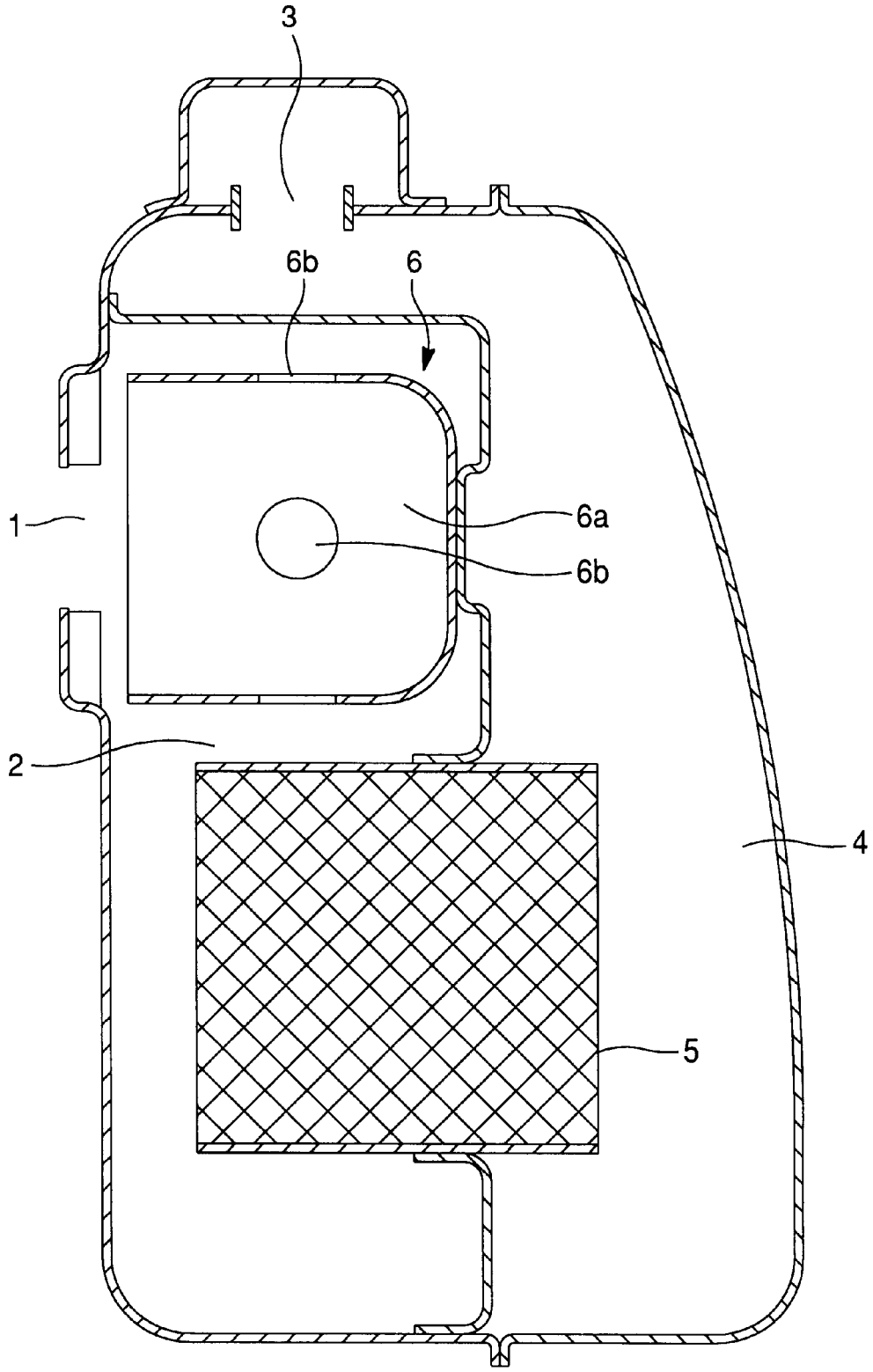
Fig. 8 Prior Art
FIG. 8 is a vertical sectional view of a conventional improved engine muffler.

Hereinafter, the soldering in the continuous hydrogen furnace 22 in the absence of oxygen will be described in more detail. Copper used as solder is interposed in the adhesive parts of the partition plates 17, 17' to the inner wall 18*a* of the muffler body 18, the adhesive parts of the partition plates 17, 17' to the second exhaust gas purifier 15 and the third exhaust gas purifier 20, the adhesive parts between components into which the muffler body 18 is divided, and the other adhesive parts of a muffler M which has been temporarily assembled. Then, as shown in FIG. 6, the mufflers M are placed on a stainless-steel belt conveyor 23 which makes the rounds in the continuous hydrogen furnace 22 in the absence of oxygen, and then are moved through the inside of the continuous hydrogen furnace 22 in the absence of oxygen at a temperature of about 120° C. As a result, the copper used as solder is melted and the soldering adhesion between each adhesive part is completed.

In this way, the adhesion of the partition plates 17, 17' to the inner wall of the muffler body 18 and the adhesion of the second exhaust gas purifier 15 and the third exhaust gas purifier 20 to the partition plates 17, 17' are conducted by soldering in the continuous hydrogen furnace 22 in the absence of oxygen, so that each adhesion can be perfectly conducted without leaving any space between each adhesive part. As a result, a part of unpurified exhaust gas does not leak from the first expansion chamber 12 to the second expansion chamber 14 and from the second expansion chamber 14 to the third expansion chamber 19, so that the effect of purifying exhaust gas can be prevented from lowering. In addition, soldering is conducted without oxygen in an atmosphere of hydrogen, so that the components of the muffler can be prevented from oxidizing while soldering is conducted.

Conventionally, the adhesion of the partition plate 17 to the inner wall of the muffler body 18 and the adhesion of the second exhaust gas purifier 15 to the partition plate 17 have been conducted by spot welding or discontinuous welding. Only the parts to be welded adhere closely and completely by spot welding or discontinuous welding, so that a part of unpurified exhaust gas can leak from the first expansion chamber 12 to the second expansion chamber 14.

On the other hand, the adhesion of the partition plate to the inner wall of the muffler body 18 and the adhesion the second exhaust gas purifier 15 to the partition plate 17 are conducted by continuous welding, and accordingly the muffler body 18 or the partition plate 17 can be deformed by the heat generated in a welding operation. For this reason, continuous welding is hardly used.

What is claimed is:

1. An engine muffler comprising:

a first expansion chamber for exhaust gas which includes an exhaust gas inlet to be connected to an exhaust port of an engine;

a second expansion chamber which includes an exhaust gas outlet;

a first exhaust gas purifier in which a catalyst for purifying exhaust gas is coated on at least a concave surface of a concave base body which has a plurality of vent holes passing through said concave surface, said first exhaust gas purifier being disposed in said first expansion chamber such that said concave surface faces said exhaust gas inlet; and at least one second exhaust gas purifier in which a catalyst for purifying exhaust gas is coated on a base body having many pores, said second exhaust gas purifier being disposed between said first expansion chamber and said second expansion chamber, wherein said first expansion chamber and said second expansion chamber are at least defined by dividing the inside of a muffler body with a partition plate, and adhesion of said partition plate to the inner wall of said muffler body and adhesion of said second exhaust gas purifier to said partition plate are conducted by soldering in a continuous hydrogen furnace in the absence of oxygen.

2. An engine muffler comprising:

a first expansion chamber for exhaust gas which includes an exhaust gas inlet to be connected to an exhaust port of an engine;

a third expansion chamber which includes an exhaust gas outlet, said third expansion chamber sharing a partition plate with said first expansion chamber such that said third expansion chamber is disposed adjacent said first expansion chamber;

a second expansion chamber which is disposed between said first expansion chamber including said exhaust gas inlet and said third expansion chamber including said exhaust gas outlet;

a first exhaust gas purifier in which a catalyst for purifying exhaust gas is coated on at least a concave surface of a concave base body which has a plurality of vent holes passing through said concave surface, said first exhaust gas purifier being disposed in said first expansion chamber such that said concave surface faces said exhaust gas inlet;

at least one second exhaust gas purifier in which a catalyst for purifying exhaust gas is coated on a base body having many pores, said second exhaust gas purifier being disposed between said first expansion chamber and said second expansion chamber; and a third exhaust gas purifier in which a catalyst for purifying exhaust gas is coated on a base body including many pores, said third exhaust gas purifier being disposed between said second expansion chamber and said third expansion chamber, wherein an air flow path within said muffler defines a substantially U-shaped configuration.

3. The engine muffler as claimed in claim 2, wherein said first expansion chamber and said second expansion chamber are at least defined by dividing the inside of a muffler body with a partition plate, and adhesion of said partition plate to the inner wall of said muffler body and adhesion of said second exhaust gas purifier to said partition plate are conducted by soldering in a continuous hydrogen furnace in the absence of oxygen.

4. An engine muffler comprising:

a first expansion chamber for exhaust gas which includes an exhaust gas inlet to be connected to an exhaust port of an engine;

a second expansion chamber which includes an exhaust gas outlet;

a first exhaust gas purifier in which a catalyst for purifying exhaust gas is coated on at least a concave surface of a concave base body which has a plurality of vent holes passing through said concave surface, said first exhaust gas purifier being disposed in said first expansion chamber such that said concave surface faces said exhaust gas inlet; and at least one second exhaust gas purifier in which a catalyst for purifying exhaust gas is coated on a base body having many pores, said second exhaust gas purifier being disposed between said first expansion chamber and said second expansion chamber; and a wire net coated with a catalyst for purifying exhaust gas, said wire net being disposed downstream of said exhaust gas outlet of said second expansion chamber.

5. The engine muffler as claimed in claim 4, wherein said first expansion chamber and said second expansion chamber are at least defined by dividing the inside of a muffler body with a partition plate, and adhesion of said partition plate to the inner wall of said muffler body and adhesion of said second exhaust gas purifier to said partition plate are conducted by soldering in a continuous hydrogen furnace in the absence of oxygen.

6. An engine muffler comprising:

a first expansion chamber for exhaust gas which includes an exhaust gas inlet to be connected to an exhaust port of an engine;

a third expansion chamber which includes an exhaust gas outlet;

a second expansion chamber which is disposed between said first expansion chamber including said exhaust gas inlet and said third expansion chamber including said exhaust gas outlet;

a first exhaust gas purifier in which a catalyst for purifying exhaust gas is coated on at least a concave surface of a concave base body which has a plurality of vent holes passing through said concave surface, said first exhaust gas purifier being disposed in said first expansion chamber such that said concave surface faces said exhaust gas inlet;

at least one second exhaust gas purifier in which a catalyst for purifying exhaust gas is coated on a base body having many pores, said second exhaust gas purifier being disposed between said first expansion chamber and said second expansion chamber; and a third exhaust gas purifier in which a catalyst for purifying exhaust gas is coated on a base body including many pores, said third exhaust gas purifier being disposed between said second expansion chamber and said third expansion chamber; and a wire net coated with a catalyst for purifying exhaust gas, said wire net being disposed near said exhaust gas outlet, wherein said first exhaust gas purifiers defines a first exhaust flow direction within said muffler and said second exhaust gas purifier defines a second exhaust flow direction within said muffler, said first flow direction being perpendicular to said second flow direction to thereby enhance a purifying function of said first and second gas purifiers.

7. The engine muffler as claimed in claim 6, wherein said first expansion chamber and said second expansion chamber are at least defined by dividing the inside of a muffler body with a partition plate, and adhesion of said partition plate to the inner wall of said muffler body and adhesion of said second exhaust gas purifier to said partition plate are conducted by soldering in a continuous hydrogen furnace in the absence of oxygen.

* * * * *

UNITED STATES PATENT AND TRADEMARK OFFICE

CERTIFICATE OF CORRECTION

PATENT NO. : 6,250,075 B1
APPLICATION NO. : 09/293975
DATED : June 26, 2001
INVENTOR(S) : Funakoshi et al.

It is certified that error appears in the above-identified patent and that said Letters Patent is hereby corrected as shown below:

On the Title Page, should read, Item
(73) Assignee: Shin-Daiwa Kogyo Co., Ltd., ~~Tokyo~~ Hiroshima (JP); and Hiraoka Mfg. Co., Ltd., Tokyo (JP)

Signed and Sealed this

Fourth Day of November, 2008

JON W. DUDAS
*Director of the United States Patent and Trademark Office*